US007419158B2

(12) United States Patent
Bohac

(10) Patent No.: US 7,419,158 B2
(45) Date of Patent: Sep. 2, 2008

(54) PUZZLE SOLVING AID AND METHOD

(76) Inventor: Greg I. Bohac, 1232 Soaring Eagle Dr., Greenwood, IN (US) 46143

( * ) Notice: Subject to any disclaimer, the term of this patent is extended or adjusted under 35 U.S.C. 154(b) by 198 days.

(21) Appl. No.: 11/373,677

(22) Filed: Mar. 13, 2006

(65) Prior Publication Data

US 2007/0210516 A1 Sep. 13, 2007

(51) Int. Cl.
*A63F 9/00* (2006.01)

(52) U.S. Cl. ..... 273/153 R; 273/148 R

(58) Field of Classification Search ..... 273/153 R, 273/157 R, 157 A, 138.1, 139, 272, 148 R; 434/177

See application file for complete search history.

(56) References Cited

U.S. PATENT DOCUMENTS 1,642,424 A * 9/1927 Massey ..... 273/153 R
1,769,961 A * 7/1930 Norrell ..... 434/177
2,055,160 A * 9/1936 Scofield ..... 434/177
4,171,815 A * 10/1979 Sturtz ..... 273/272
4,595,203 A * 6/1986 DeLano et al. ..... 273/148 R
4,674,192 A * 6/1987 Libit ..... 434/109
5,149,097 A * 9/1992 Tonello et al. ..... 273/148 R
5,288,068 A * 2/1994 Roth ..... 273/153 R
2007/0182097 A1* 8/2007 Dowe ..... 273/272

* cited by examiner

*Primary Examiner*—Steven Wong
(74) *Attorney, Agent, or Firm*—Daniel J. O'Connor

(57) ABSTRACT

A puzzle solving aid in combination with a sudoku-type numerical puzzle. The puzzle solving aid (PSA) comprises a square or rectangular sheet having opaque or clouded portions at the four outer corners thereof and clear portions forming a vertical see-through column and a horizontal see-through row. The puzzle solving aid includes a central open area so a puzzle solver can pencil in the possible solution numbers for a particular space on a puzzle grid. A method of use related to puzzle solving and a business method for marketing a combined puzzle and puzzle solving aid are described.

1 Claim, 7 Drawing Sheets

10

16

| | | | | | | | | |
|---|---|---|---|---|---|---|---|---|
| | 1 | | | | | | | |
| | 5 | | 6 | 1 | | 7 | 9 | |
| 4 | | | 7 | | | | | |
| | 8 | | 2 | | | | | |
| 2 | | | 3 | 7 | | | 5 | |
| 1 | | | | | 6 | | 8 | 4 |
| | | 4 | | | | 3 | | |
| 7 | | | | 3 | 5 | | | |
| | 6 | | 9 | | 2 | | | |

FIG. 1.

PUZZLE SOLVING AID AND METHOD

BACKGROUND AND OBJECTS OF THE INVENTION

The present invention is generally related to the game, puzzle and puzzle solving arts and, in particular, to a novel puzzle solving aid structure and method of use.

Sudoku-type puzzles have been used in the art for many years. The term "sudoku" is generic and broadly signifies number placement. Many different styles and configurations of sudoku-type puzzles are known in the art.

FIG. 1 shows a sudoku puzzle configuration which is widely used in the United States and internationally. It includes a nine-by-nine grid totaling eighty-one (81) spaces and is subdivided into nine boxes of nine spaces each.

The puzzle is presented by the puzzle creator to the puzzle solver in the format shown in FIG. 1, i.e. about 25 to 31 of the spaces are filled in by the puzzle creator. The solver must fill in the empty spaces using numerals 1-9 in the manner of sudoku play.

Various sudoku publications and puzzle books have described suggested methods of solving a sudoku puzzle. Such methods typically involve having the puzzle solver focus on a particular number or a particular area of the puzzle to begin a process of elimination and to thus make a tentative beginning regards solving the entire puzzle.

It is an object of the present invention to set forth a puzzle solving aid which is utilized to make a first pass through the entire puzzle and to quickly and easily list all of the possible solution numbers. Such listing is done, in pencil, on the puzzle by means of a central aperture on the puzzle solving aid.

It is also an object of the invention to show a method of sudoku puzzle solving in combination with a specially designed puzzle solving aid.

It is a further object to demonstrate a novel puzzle solving apparatus which may be economically manufactured for widespread commercial appeal.

It is a still further object of the overall invention to teach a unique business method in which a specially designed sudoku puzzle solving apparatus is marketed in combination with a sudoku puzzle book to promote ease of solution and consequent enhanced sales for the publication.

These and other objects and advantages of the described invention will be apparent to those of skill in the art from the description and drawings which follow.

SUMMARY OF THE INVENTION

The invention comprises several unique aspects which relate to puzzle solving generally and to the sudoku configurations in particular.

A puzzle solving aid (PSA) is comprised of a sheet having four opaque quadrants to cover portions of the puzzle so that a puzzle solver can quickly and easily make a first pass through the puzzle and enter all of the possible numerical solutions. The puzzle solving aid has transparent column and row areas and a central open area so the user can pencil in the possible solution numbers.

The method of use involves placing the puzzle solving aid over each of the open spaces of the puzzle and entering the appropriate numbers in a first pass through the puzzle.

The business method comprises the combination of a special puzzle solving aid with a puzzle book and marketing the combination to encourage sales of the sudoku puzzle books.

BRIEF DESCRIPTION OF THE DRAWING FIGURES

FIG. 1 shows a sudoku numerical puzzle grid 10 having a space 16 in an upper left portion of the grid.

FULL DESCRIPTION OF THE PREFERRED EMBODIMENTS

Figure 2:
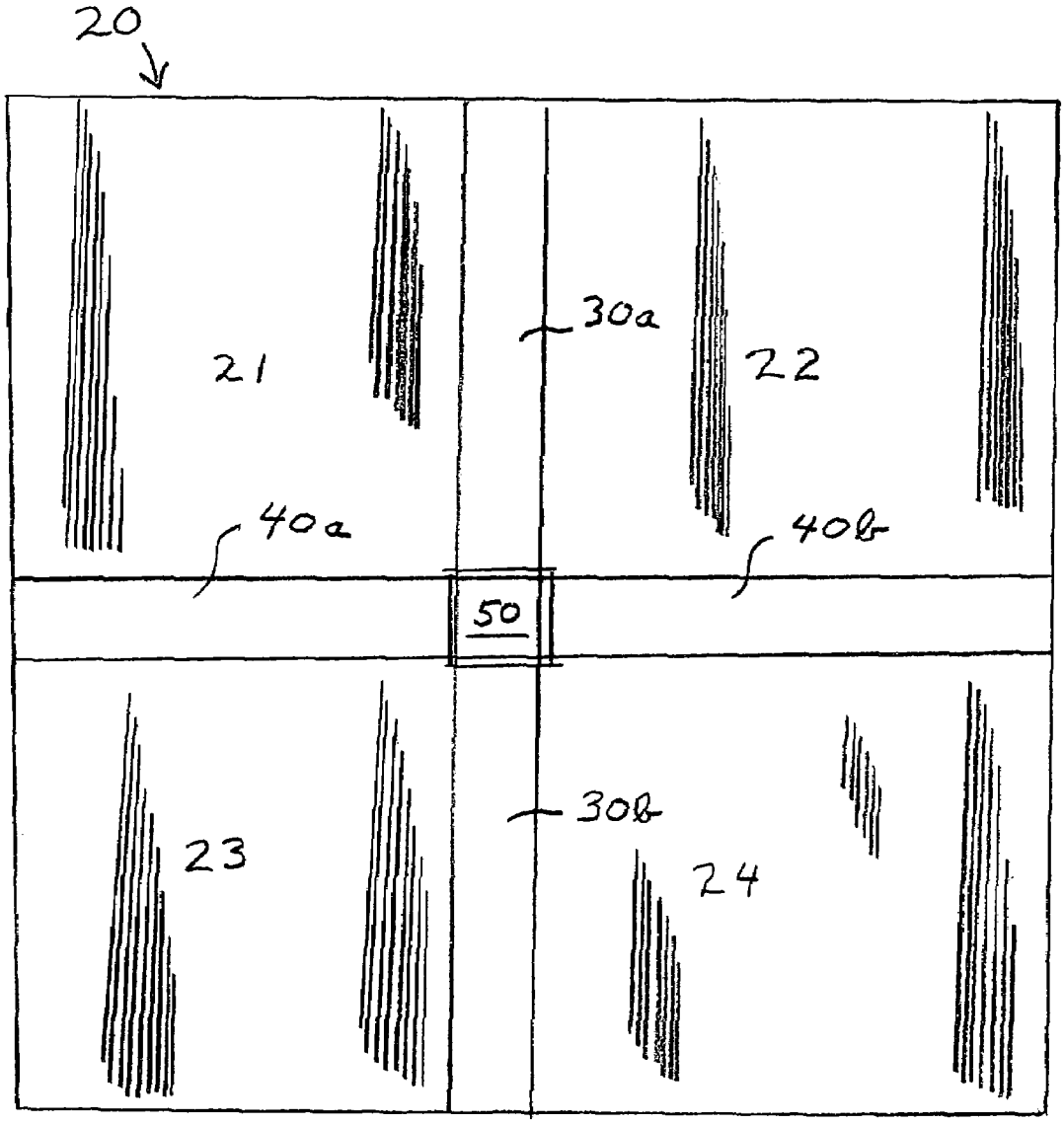
FIGS. 2 and 3 show top and side schematic views of the puzzle solving aid of the invention.

Referring to FIG. 1, a typical sudoku grid is shown. The grid comprises eighty-one (81) spaces total. The overall grid 10 has nine (9) boxes formed therein. Space 16 is at the upper left.

At the start of the puzzle, a certain number of spaces are filled in by the puzzle creator. In the example of FIG. 1, a total of twenty-six (26) numbers have been filled in.

The rules for this type of puzzle are simply stated as follows: Complete the grid so that every row, column and 3×3 box contains every digit from 1 to 9 inclusively.

Other types and shapes of sudoku grids are known such as elongated, circular et cetera. However, the square grid puzzle shown in FIG. 1 is the most common type in current use by puzzle solvers.

The publications in the prior art suggest various puzzle solving strategies such as focusing on a particular number or box and working via elimination and logic.

Figure 3:
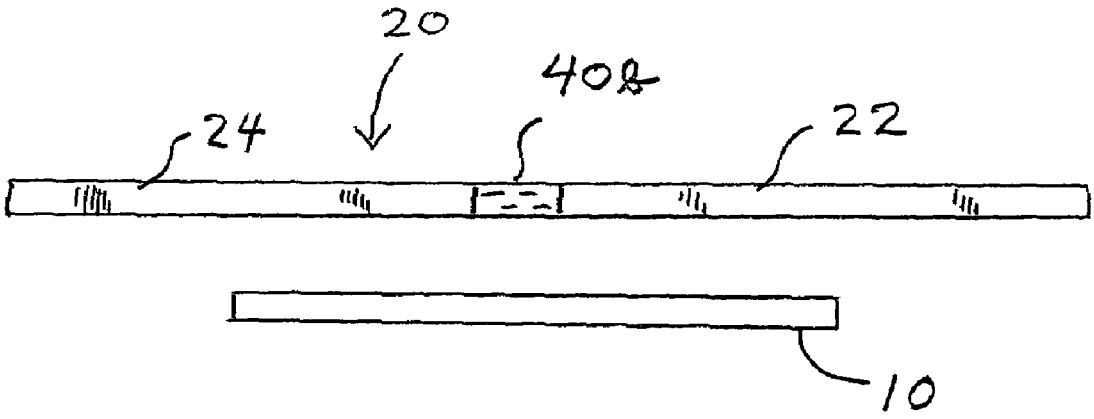

Referring to FIGS. 2 and 3, top and side views of the puzzle solving aid (PSA) are shown in a schematic manner.

The puzzle solving aid (PSA) 20 is shown as having four outer quadrants 21, 22, 23 and 24. The quadrants may be fabricated of opaque paperboard, a plastic or other equivalent material.

The four quadrants are separated by means of clear vertical portions 30*a*, 30*b* and also by clear horizontal portions 40*a* and 40*b*. The clear portions are made of a see-through plastic and are joined to the outer quadrants 21-24 via tape, adhesive, laminating or other joining methods known in the art. Alternatively, the overall puzzle solving aid (PSA) may be a one-piece printed paperboard or plastic layer.

As further shown in FIG. 2, the puzzle solving aid has a central open area 50. Open area 50 is of a size so that it can be aligned over a single space of the overall grid 10 in a process to be further described.

Figure 4:
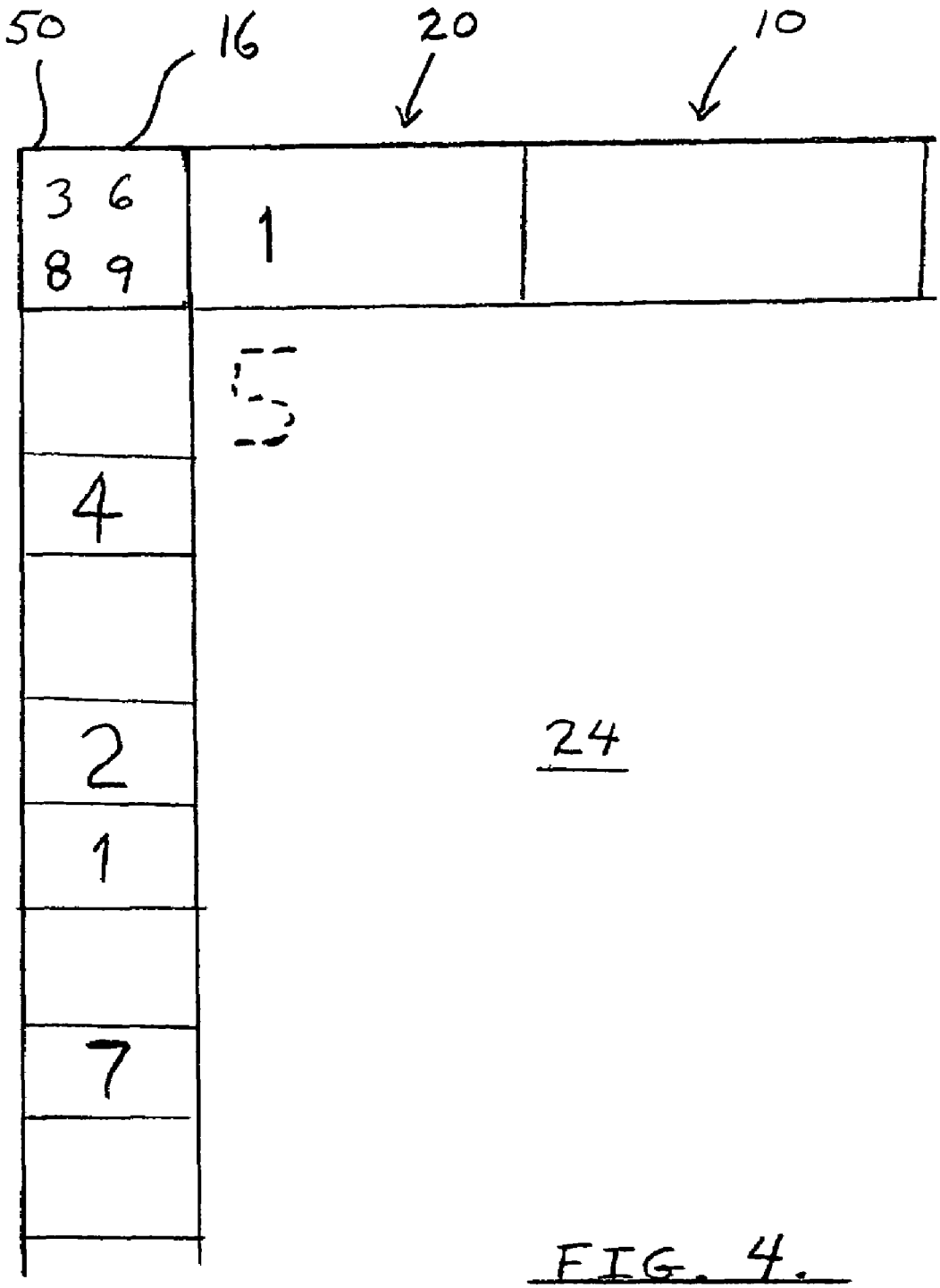
FIG. 4 shows a schematic top view with the puzzle solving aid (PSA) being placed over the puzzle so that upper left grid space 16 is available to be pencilled in. The method of making a first pass through the puzzle is illustrated.

When the puzzle solving aid 20 is placed over the puzzle 10 with aperture 50 over the space 16 of the puzzle, the top row and the leftmost column of the puzzle become visible as shown in FIG. 4.

As shown in FIG. 4, the puzzle solver would know that numbers 1, 2, 4 and 7 are not available for space 16. The puzzle solver, by slightly moving the puzzle solving aid (PSA) 20, would also know that the number 5 is not available for space 16.

Therefore, the puzzle solver can quickly and easily fill the numbers 3, 6, 8 and 9 into the space 16 as is shown in FIG. 4.

In the particular puzzle of FIG. 1, the puzzle creator has filled in numbers in 26 of the 81 total spaces. This leaves a total of 55 spaces for the puzzle solver to fill in. Thus, the puzzle solver simply moves the puzzle solving aid (PSA) over the puzzle 10 so that aperture 50 lies over the various puzzle spaces to be filled in. A quick and efficient "first pass" over the puzzle is thereby achieved.

Once this advantageous starting point has been established, i.e. the blank spaces have been filled in with the correct possible solution numbers using the PSA, the puzzle solver can then proceed to use elimination, comparative and logical reasoning to solve the puzzle.

It is this first pass starting point, facilitated by the puzzle solving aid, wherein the possible solution numbers are easily filled in, that makes the puzzle much more efficiently and more enjoyably solved.

Figure 5:
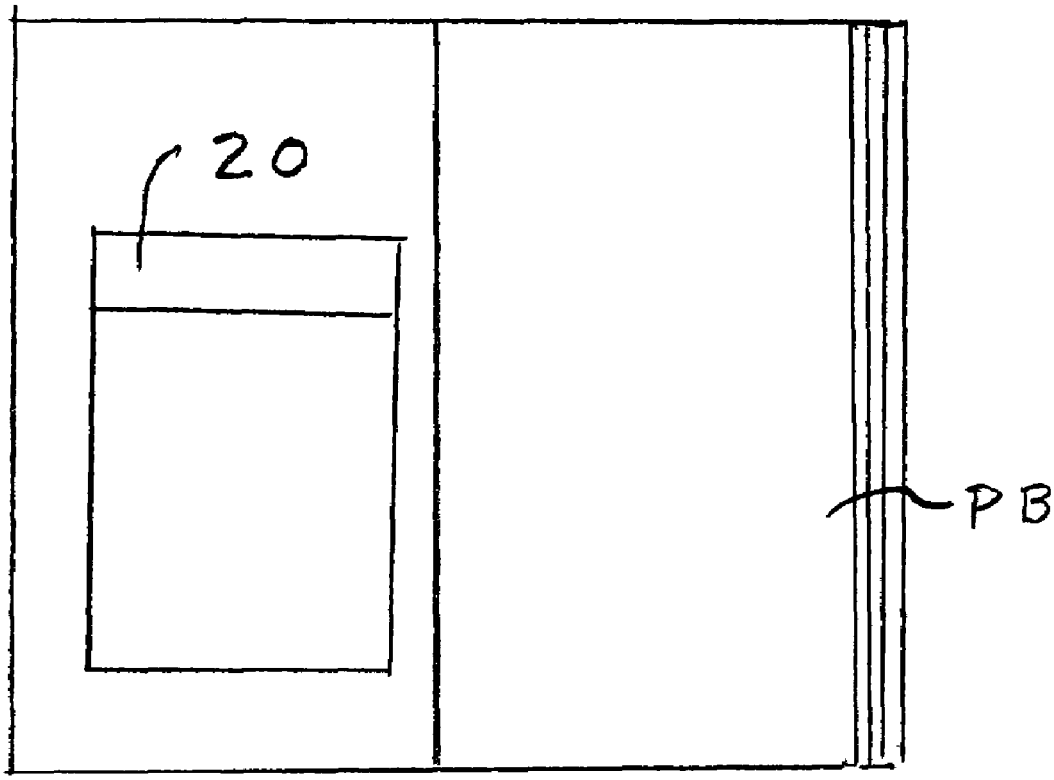
FIGS. 5 and 6 illustrate the business method of marketing the puzzle solving aid (PSA) with the puzzle books and sudoku puzzles generally.

FIG. 5 illustrates the business method aspect of the invention wherein the specially designed puzzle solving aid 20 is sold with a puzzle book designated as "PB" in FIG. 5.

The advantages of this marketing business method are clear since there are currently many competing sudoku-type puzzle books being offered for sale in bookstores and related venues.

Figure 6:
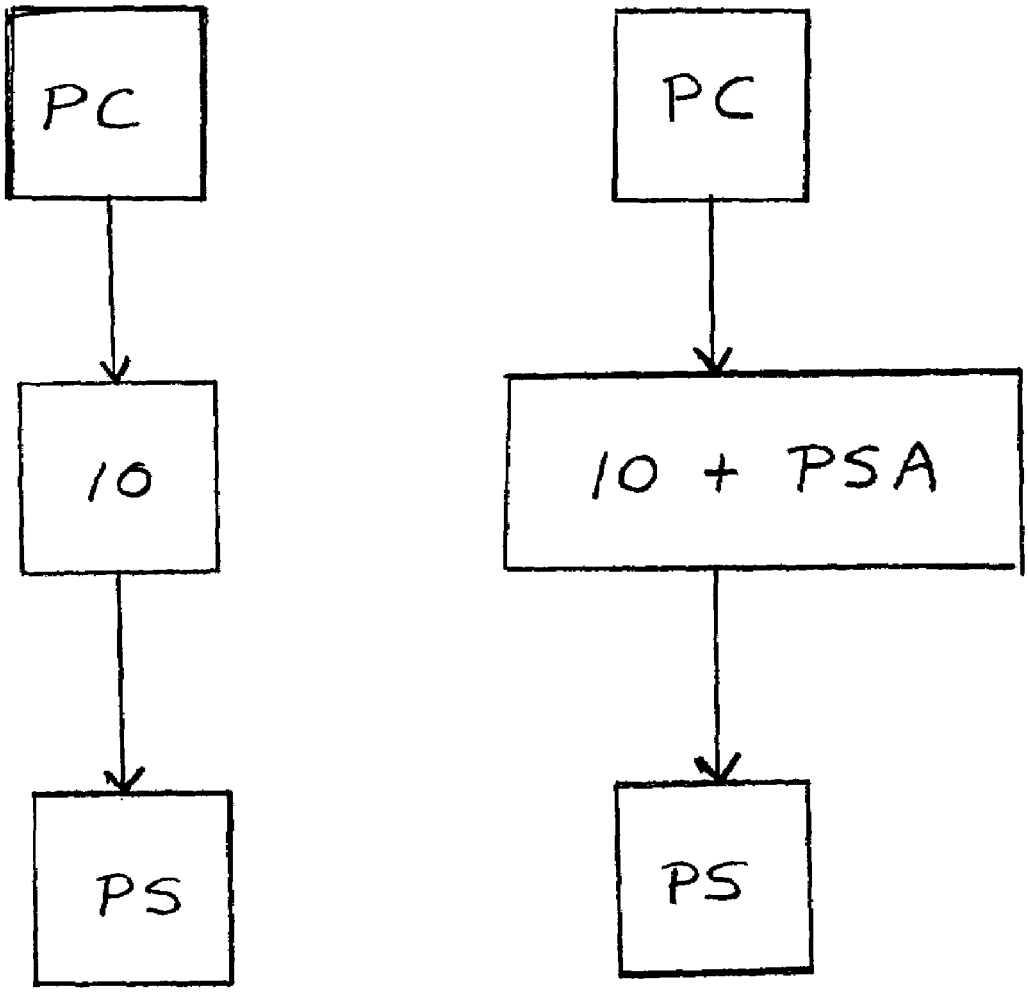

FIG. 6 further illustrates the business method logic of the overall invention. As shown, the puzzle creator PC normally forwards a puzzle 10 to the puzzle solver PS. In accord with the principles set forth herein, it would be highly advantageous for the companies representing the puzzle creator PC to include the puzzle solving aid (PSA) into their marketing strategies.

Figure 7:
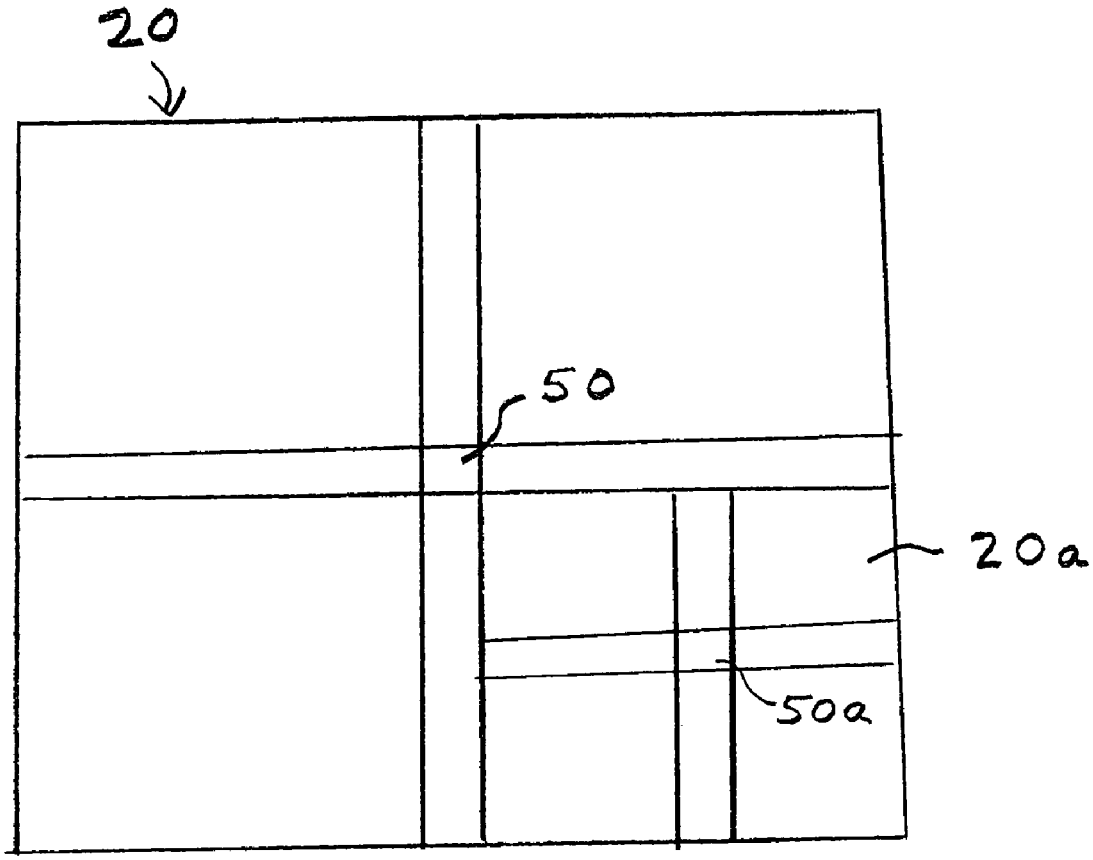
FIG. 7 shows a combined puzzle solving aid having a first section for working on larger puzzles and a second section for solving smaller puzzles.

FIG. 7 is a modification of the puzzle solving aid 20 of FIG. 2.

As shown in FIG. 7, the puzzle solving aid has a section 20*a* at the lower right hand thereof which can be utilized for smaller puzzles having a smaller print type.

Section 20*a* is combined into the larger overall sheet 20 for maximum adaptability and portability by a puzzle solver. Open area 50*a* corresponds to the open area 50 previously described.

It is submitted that the broader aspects of the solving aid have applicability to other shapes and styles of sudoku-type puzzles.

While a particular structure and method of use have been shown and described, it is intended in this specification to broadly cover all equivalent structures and methods of use.

The invention is further defined by the claims included herewith.

I claim:

1. A method of solving a sudoku number puzzle which comprises a grid of eighty-one spaces and which is subdivided into nine boxes of nine spaces each, wherein, at the start of the puzzle-solving process, a portion of the eighty-one spaces have been filled in by a puzzle creator, said method of solving comprising the following steps:

a) placement of a puzzle solving aid over portions of the puzzle, said puzzle solving aid comprising four quadrants of opaque means which are separated by a clear plastic vertical column and by a clear plastic horizontal row, said puzzle solving aid further including a central open area means at the intersection of the plastic vertical column and the plastic horizontal row, b) providing that a puzzle solver write in the numbers which are possible for a particular space which underlies the central open area, c) providing that the puzzle solving aid is square or rectangular in overall shape and is utilized with a puzzle having only numbers as a part thereof, d) providing that the numbers which are written in by the puzzle solver are those which are not shown in a visible vertical column or in a visible horizontal row, e) providing that the numbers which are written in by the puzzle solver are also not shown in a three-by-three box area being worked by the puzzle solver.

* * * * *